United States Patent [19]

Meihofer et al.

[11] 4,100,012

[45] Jul. 11, 1978

[54] DRIVEN NIP ROLL SPLICER

[75] Inventors: Edward F. Meihofer, Norfolk; George F. Corcoran, Wellesley; John W. Clifford, Ashland, all of Mass.

[73] Assignee: Butler Automatic, Inc., Canton, Mass.

[21] Appl. No.: 739,794

[22] Filed: Nov. 8, 1976

[51] Int. Cl.[2] ..... B65H 19/14; B65H 25/00

[52] U.S. Cl. ..... 156/351; 156/361; 156/495; 156/504; 156/505; 242/58.3; 242/58.4

[58] Field of Search ..... 156/504, 351, 361, 515, 156/544, 505, 495, 157, 159; 242/58.1, 58.4, 58.5, 58.3

[56] References Cited

U.S. PATENT DOCUMENTS

| | | | |
|---|---|---|---|
| 2,963,234 | 12/1960 | Chase et al. | 242/58.3 |
| 3,713,600 | 1/1973 | Murray et al. | 242/584 |
| 3,785,902 | 1/1974 | Preston et al. | 156/504 X |
| 3,939,032 | 2/1976 | Taitel et al. | 242/58.4 X |
| 3,971,524 | 7/1976 | Nudinger et al. | 156/504 X |
| 3,989,576 | 11/1976 | Collin | 156/504 X |

FOREIGN PATENT DOCUMENTS

| | | | |
|---|---|---|---|
| 964,006 | 7/1964 | United Kingdom | 156/504 |

*Primary Examiner*—Michael G. Wityshyn

*Attorney, Agent, or Firm*—Cesari & McKenna

[57] ABSTRACT

Web splicing apparatus employs a pair of driven nip rolls which controllably feed web from a running roll into a festoon as web is drawn out of the festoon at a constant rate by a downstream web consuming machine. The nip rolls are driven by a DC motor connected in a closed loop servo system which compares the speed of the web entering the festoon with the web line speed to develop a command signal for the motor. During normal operation, the command signal includes a web velocity trim signal developed by monitoring the position of the festoon dancer relative to a selected reference position so as to minimize tension upsets and to maintain the dancer within its control range. During a splice sequence, the command signal comprises a deceleration ramp having a selected slope to provide controlled deceleration of the web to minimize tension upsets and to permit actuation of the splicing nips prior to actual web stop. After the splice is made, the command signal comprises an acceleration ramp whose slope is automatically adjusted to apply the least necessary tension to the ready web for new roll acceleration consistent with a given splicing speed. Further with this arrangement, the gain of the system is independent of the changing size of the expiring roll.

14 Claims, 3 Drawing Figures

DRIVEN NIP ROLL SPLICER

BACKGROUND OF THE INVENTION

This invention related to web splicing apparatus. It relates more particularly to apparatus of this type which makes a splice between two webs while minimizing tension upsets in the web. Although the invention has application to splicers used in conjunction with unwind stands as well as those used with rewind stands, we will specifically describe the invention only in the former context.

Constant tension web splicers have been used for many years to splice the trailing end of a running web to the leading end of a ready web so that web can proceed uninterruptedly to a downstream web consuming machine. A splicer typically includes a pair of roll stands for holding web rolls, one of which is running and the other of which is at the ready.

Web from the running roll is guided through a splicing station and into a festoon where a supply of web is maintained to service the downstream web consuming machine when the running roll is slowed or stopped to make a splice. When the running roll is about to expire, it is braked and the leading end of the ready web, already prepared and placed at the splicing station, is adhered to the running web at the splicing station. Then the web from the running roll is severed upstream from the splice and the ready web is accelerated up to line speed with the depleted festoon being refilled with web in the process.

Normally, to minimize tension upsets in the web, the position of the festoon dancer is monitored with respect to a selected reference position to produce an error signal that is indicative of a tension change in the web. This error signal is then used to control the brakes on the unwind stand (or the winding motor on the rewind stand) so that the brakes release or retard the running web as needed to return the dancer to its reference position and thus relieve the tension upset.

Invariably, prior web splicing apparatus maintain constant tension in the web by adjusting the braking torque on the running roll. Consequently the web tension correction is, of necessity, applied through the running roll whose size is constantly changing. Therefore, in order to maintain even reasonably stable festoon control, the overall gain of the control system has to be changed to compensate for the change in roll size. Thus the prior splicing systems require various follower arms, optical sensors or the like to monitor roll size and the ancillary electronics to convert that measurement into the required system gain change, making the prior apparatus unduly complicated and costly.

Further, even in the prior arrangements which do compensate for change in roll size, stable festoon control is not achieved because of irregular characteristics in the usual roll stand brakes due to wear, bearing conditions and the like. These conditions prevent the application of a braking torque to the roll stand in response to a dancer position error signal that when coupled through the unwinding roll results in a web tension change that precisely returns the dancer to its reference position. This problem can be overcome to some extent by using high performance brakes whose characteristics do not vary appreciably with time, wear, excessive heating, etc. However the cost of obtaining such brakes is very high. Moreover, the cost of operating these brakes, as well as other conventional brakes, is quite high because they are always energized to some extent to impart a drag on the running web and a large amount of this energy is dissipated as heat.

Still further, stable festoon control is difficult to achieve with conventional splicers because the festoon dancer invariably has considerable inertia which slows its response to tension upsets. This, in turn, stems from the fact that the dancer has to be able to withstand very strong impacts in the event that it is driven to the stops during a web break and also because the dancer is biased towards its maximum storage position by pneumatic cylinders which contain trapped air and have high starting friction.

Another disadvantage of conventional splicing systems which control web tension by varying the braking torque applied to the running roll is that the entire span of web between the festoon dancer and the running roll is under full tension. As the length of the tensioned web span increases, there is a greater likelihood of there being a weak spot that could be the site of an incipient web break. Therefore it is highly desirable to minimize the length of the web span that is maintained under full tension. Also in actual practice, when large web rolls are braked, an extremely large torque is coupled through the roll core and the roll convolutions adjacent the core that tends to cause tears at those points.

Finally, prior systems of this general type require a relatively long time to effect the splice because of the time delays and inertia inherent in the splicing nips and knives. Nor do they attempt to control the deceleration and acceleration phases of the splicing sequence to apply the least necessary tension to the particular web being spliced.

SUMMARY OF THE INVENTION

Accordingly the present invention aims to provide splicing apparatus which does provide the least necessary tension to the web being spliced for a given splicing speed.

Another object of the invention is to provide a splicer that controllably feeds web into the splicer festoon to maintain a set dancer position and therefore a set tension during tension upsets.

A further object of the invention is to provide splicing apparatus that maintains stable festoon control without any gain compensation for changing roll size.

Still another object of the invention is to provide splicing apparatus that controllably decelerates the expiring web to minimize tension upsets therein and to permit advance actuation of the splicing nips before the expiring web is actually brought to a stop.

Still another object is to provide a splicer that controllably feeds web into the festoon to maintain the festoon dancer within its control range and thereby to maintain a set tension throughout roll builddown.

Another object of the invention is to provide splicing apparatus that controllably accelerates the ready web in such a way as to limit the required web tension to a preset maximum value.

Still another object is to provide splicing apparatus that achieves web tension control on a much more efficient basis than is the case with prior comparable splicers.

Still another object is to provide a splicer which eliminates reliance on the characteristics and condition of the roll stand brakes.

A further object is to provide a splicer whose festoon dancer is highly responsive to web tension upsets, yet which operates reliably in the event of a web break.

Other objects will, in part, be obvious and will, in part, appear hereinafter.

The invention accordingly comprises the features of construction, combination of elements and arrangement of parts which are exemplified in the following detailed description, and the scope of the invention will be indicated in the claims.

Briefly, instead of maintaining constant web tension during roll builddown by controlling braking torque at the roll stand in response to festoon dancer position, the present splicing apparatus controls web tension by a pair of driven nip rolls that controllably feed web into the festoon. The nip rolls are driven by a DC motor connected in a closed loop servo system. During roll builddown, the armature voltage through the DC motor is controlled by a command signal that is a function of the difference between the speed of the web entering the festoon and line speed and also the deviation of the festoon dancer from its reference position. Thus the motor feeds web into the festoon at a rate to maintain the dancer within its control range and to maintain a set tension during tension disturbances throughout roll builddown. During the deceleration phase of the splice sequence, the command signal controlling motor voltage is in the form of a deceleration ramp having a selected slope that causes the motor to controllably decelerate the web to minimize tension upsets and to permit advance actuation of the splicing nips before the web is actually brought to a stop. Then after the splice is completed, the command signal to the motor is an acceleration ramp whose slope is automatically adjusted to apply the least necessary tension to accelerate the new roll consistent with a given splicing speed. Thus the tension applied to the web during acceleration is limited to a preset maximum value commensurate with the weight of the roll.

Since tension control is achieved by driven nip rolls right at the entrance to the festoon, the web span that is maintained under a high tension is minimized. Furthermore, this mode of tension control insures a fixed gear-in-ratio to the web so that there is no need to vary the gain of the control system as roll size diminishes. For the same reason, variations in the performance of the roll stand brake are not reflected as tension upsets in the web. The utilization of controllably driven nip rolls instead of roll stand brakes to control web tension results in further economies due to the fact that the hold back force on the web is produced by the DC motor functioning in a generating mode thereby returning power to the utlity line.

Finally, the present system achieves a fast response to tension upsets because the dancer itself has a minimum amount of inertia in that its weight is kept to a minimum and the dancer is preloaded, not by the usual air cylinders, but rather by a constant speed AC tension control motor operating through a clutch. Accordingly if there is a web break, the dancer is not driven abruptly to its stops, but rather proceeds there relatively slowly as governed by the speed of the tension control motor.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENT

Figure 1:
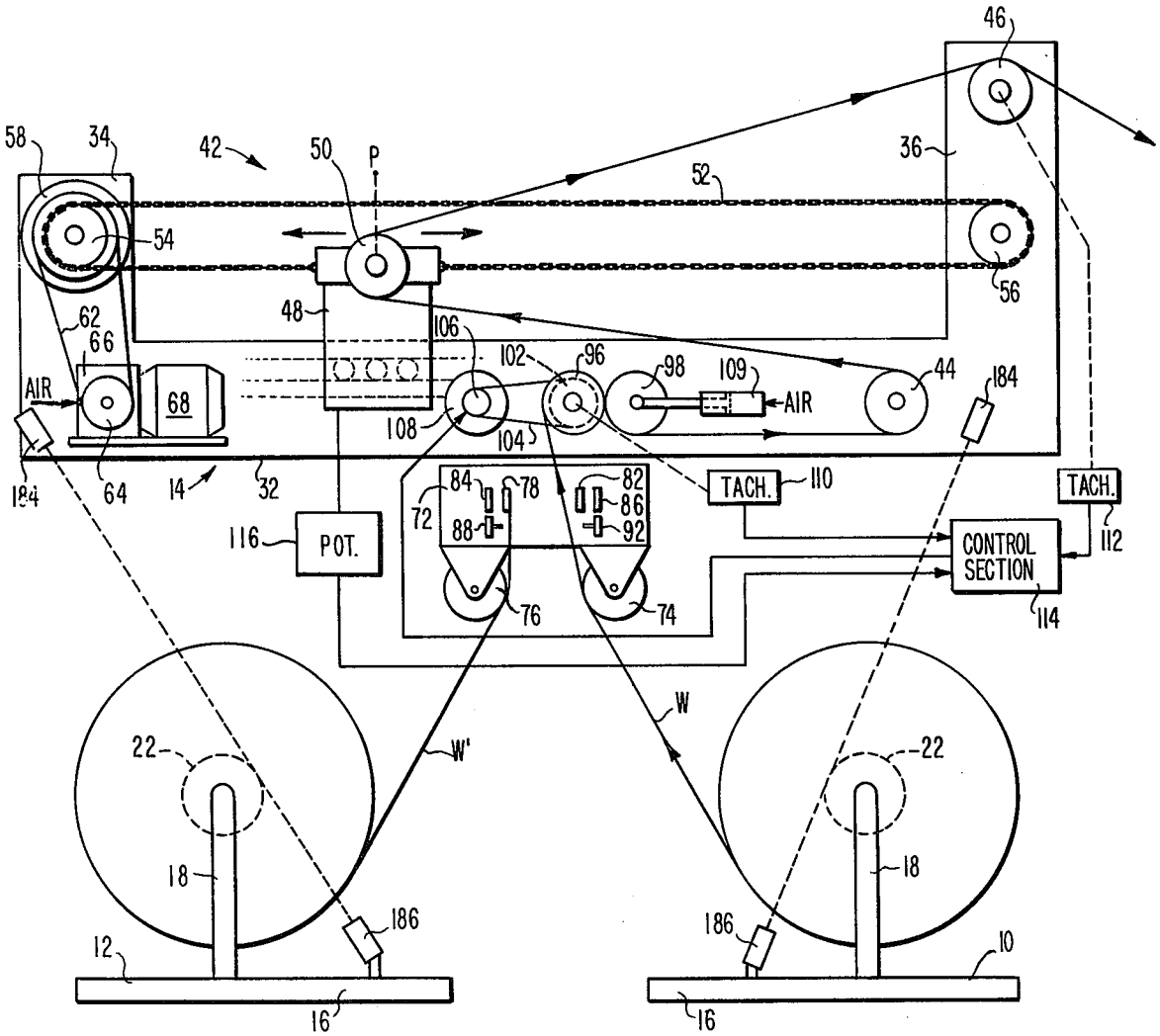
FIG. 1 is a diagrammatic view of splicing apparatus embodying the principles of this invention.

Referring now to FIG. 1 of the drawings, a pair of roll stands 10 and 12 are positioned under an overhead bridge shown generally at 14. The roll stands 10 and 12 can be of the fixed or so-called Langston type or they may be roll stands of the rollout or Martin type. Each stand includes a base 16, a pair of upright standards 18 terminating in roll chucks (not shown) that support or engage the roll core from opposite ends. Each roll stand includes two brakes indicated in dotted lines at 22. In the drawing figure, roll stand 10 holds a running web W while, roll stand 12 holds a roll of ready web W'.

Bridge 14 which supports the major components of the splicer includes a pair of spaced-apart longitudinal beams 32, only one of which is shown. Pairs of upright standards 34 and 36 are positioned at opposite ends of beams 32.

The bridge 14 supports a dancer assembly shown generally at 42. The assembly includes a fixed idler roller 44 rotatively mounted between the right hand ends of beams 32 and another idler roller 46 rotatively mounted between standards 36 near the tops thereof. A movable dancer 48 including a dancer roller 50 is positioned between beams 32 and is arranged to move horizontally along the length of those beams on suitable tracks (not shown). Dancer 48 is moved along beams 32 by means of pairs of chains 52 looped around pairs of sprockets 54 rotatively mounted on standards 34 and similar sprockets 56 rotatively mounted on standards 36, the opposite ends of the chain being secured to dancer 48. At least one sprocket 54 is rotatively fixed to a pulley 58. A belt 62 engages around pulley 58 and also around a second pulley 64 connected to the output of a pneumatic clutch 66 which is driven by a constant speed AC motor 68. The amount of slippage in clutch 54 is determined by the air pressure applied to clutch 66. Normally the air pressure is maintained constant so that a constant force is applied to the dancer biasing it towards its maximum storage position, i.e., to the left in FIG. 1, so as to maintain a set tension in the web, e.g., between 50 lbs. and 150 lbs. An electrically operated, variable slip clutch can be used in lieu of cluth 66.

The splicer also includes a splicing section indicated generally at 72. The splicing section may assume a variety of forms. A suitable one is shown in U.S. Pat. No. 3,858,819. Suffice it to say that section 72 includes a pair of idler rollers 74 and 76 for guiding web from roll stands 10 and 12 into the splicing section. Section 72 also has means for pressing the webs W and W' together to make the splice and means for severing the running web upstream from the splice. The pressing means may consist of nip rolls or, as in the illustrated embodiment and the aforesaid patent, a pair of removable web edge preparation bars 78 and 82. These bars are pressed together to make the splice by a pair of pneumatically controlled pressure pads 84 and 86. A pair of pneumatically operated knife blades 88 and 92 are incorporated into pads 78 and 82. The operation of these various components of the splicing section 72 is conventional and fully disclosed in the aforesaid patent. Therefore it will not be detailed here.

During a splice sequence, after the running web is slowed or brought to a stop, pads 84 and 86 are urged toward one another thereby pressing webs W and W' together between bars 78 and 82. Following that, the knife adjacent the running web, i.e., knife 92, is actuated to sever the web upstream from the splice. Then the pressure pads 84 and 86 are retracted thereby freeing the web which is now drawn from the roll of ready web W'.

In the present splicing apparatus, the running web is controllably fed into the festoon 42 by means of a pair of nip rolls 96 and 98 rotatively mounted between beams 32 directly above the splicing section 72. Roll 96 carries a pulley 102 connected by a belt 104 to a second pulley 106 on the shaft of a DC motor 108 mounted on a beam 32. Roller 98 is biased toward roller 96 by an air cylinder 109. Web from the running roll, in this case web W, is passed over the top of roller 96 and under roller 98 and thence around idler roller 44, dancer roller 50, idler roller 46 to the downstream web consuming machine as indicated in FIG. 1.

During normal operation of the apparatus, dancer 48 is biased towards its maximum storage postion, i.e., to the left in FIG. 1 by application of a selected air pressure to pneumatic clutch 66. The pressure is selected so that there is just enough slippage in the clutch to impart a selected tension to the web in the festoon, typically on the order of 50–150 lbs. It is important to note that this high tension is applied to the web only in the web span or length downstream from the nip rolls 96 and 98. In the usual case, the roll stand brakes 22 are only used to impart a slight drag to the running roll to prevent the roll from overrunning. However, there are some situations in which brakes 22 can be used in a supplementary manner as will be described later.

The loading of the dancer 48 by means of the motor clutch arrangement instead of air cylinders lowers the inertia of the dancer and thus permits it to respond more quickly to tension upsets. The reduced inertia is due to the elimination of the customary air cylinders and a sizable reduction in the weight and size of the dancer components. Still if there should be a web break, the dancer will not be damaged even if it is driven to its stops. This is because when web tension is so relieved, the clutch 66 no longer slips so that the dancer moves toward its limits at a fixed slow rate dependent upon the speed of the motor 68.

Still referring to FIG. 1, a tachometer 110 driven by nip roller 96 monitors the speed of web entering the festoon and a second tachometer 112 driven by idler roller 46 monitors the speed of the web leaving the festoon, i.e., line speed. The outputs of the two tachometers are applied to a control section 114. Along with this information, section 114 receives a web velocity trim signal provided by a potentiometer 116 which monitors the position of dancer 48 with respect to a fixed reference position P. Because the present system achieves very stable dancer control, position P can be as close as two inches from the maximum storage position so that a maximum amount of web is available in reserve for the splice sequence.

Control section 114 processes the information from tachometers 110, 112 and potentiometer 116 and develops a command signal which controls the voltage applied to the DC drive motor 108. During normal operation of the splicing apparatus, the voltage applied to the drive motor is substantially constant, varying only to decrease or increase the speed of web entering the festoon 42 to compensate for tension upsets in the web as detected by excursions of the dancer 48 from its selected reference position. During a splice sequence, section 114 develops a command signal for the drive motor 108 in the form of a decelerating ramp whose slope brings the running web to a stop within a selected period of time. This controlled deceleration of the web minimizes tension upsets and also permits advance actuation of the splicing nips before the running web is actually brought to a stop. This helps to minimize the duration of the splice sequence and thereby minimize the amount of storage capacity required in festoon 42. After the splice is completed, section 114 generates a command signal in the form of an accelerating ramp which controllably accelerates the ready web up to line speed in such a way as to apply the least necessary tension to accelerate the new roll consistent with the given splicing speed. Thus the slope of the accelerating ramp is controlled to limit the tension applied to the ready web to a preset maximum value.

Figure 2:
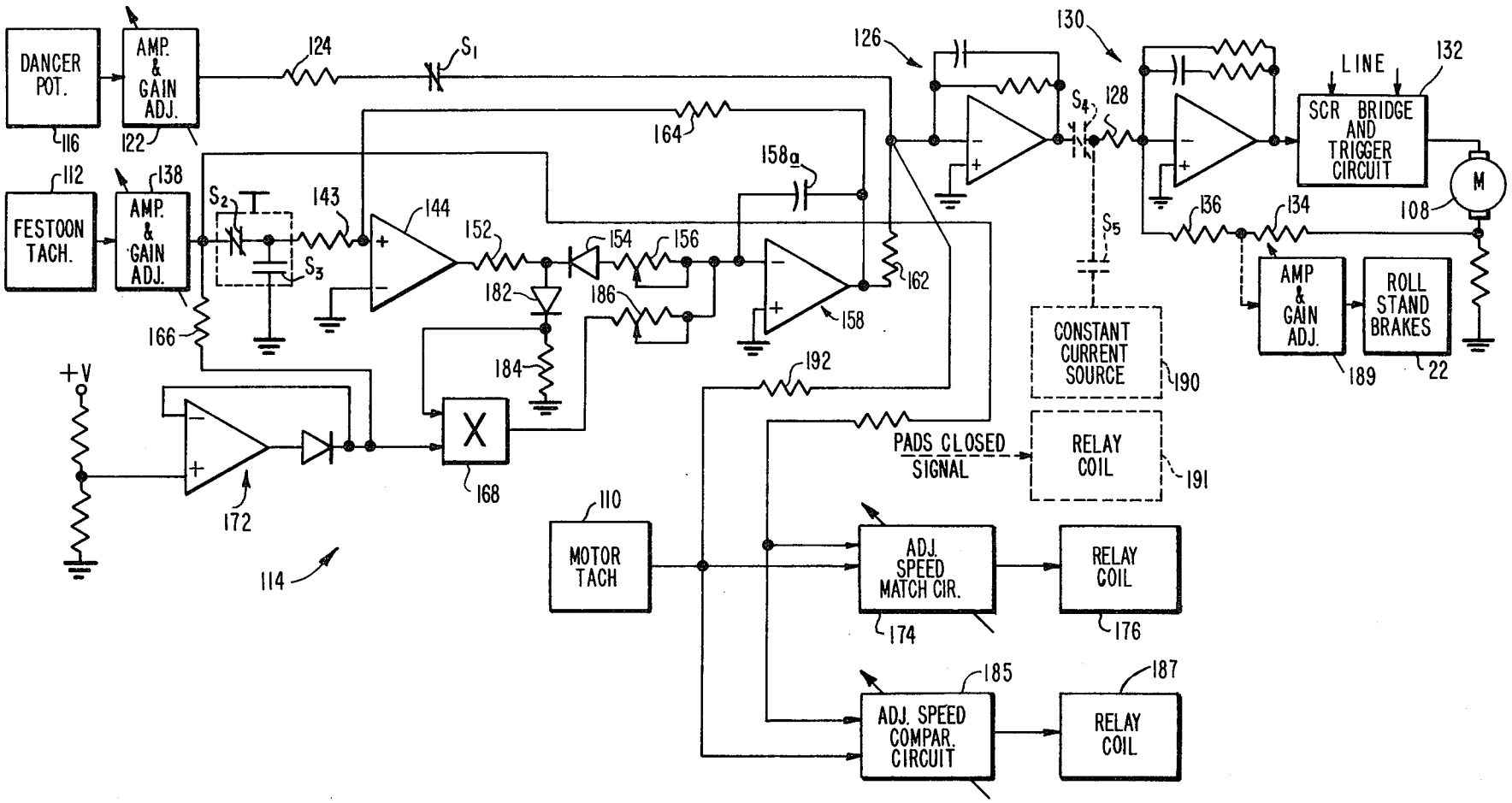
FIG. 2 is a schematic diagram detailing certain parts of the FIG. 1 apparatus.

Turning now to FIG. 2, the control section 114 comprises a servo loop that is closed around the DC drive motor 108, the inputs to the servo loop being from the tachometers 110 and 112 and the dancer potentiometer 116.

More particularly, the voltage across the potentiometer 116 as picked from its center tap is applied to an amplifier 122 having an adjustable gain control. The output of the amplifier 122 is applied by way of a resister 124 and normally closed switch S1 to the input of an error signal amplifier 126. The output of amplifier 126 is a command signal which is applied by way of a resister 128 to a current generator 130. The current generator, in turn, controls an SCR bridge and trigger circuit 132 that applies voltage to the armature of motor 108 from a line source in proportion to the magnitude of the command signal. Current feedback from the motor armature to the input of current generator 130 is afforded by way of series connected resisters 134 and 136.

The output signal from tachometer 112 is applied to an amplifier 138 that also has a gain adjustment. The signal from amplifier 138 is coupled via a normally closed switch $S_2$ and a series resister 143 to the input of an operational amplifier 144. The junction point between switch $S_2$ and resister 143 is also connected to ground by way of a normally open switch $S_3$. Switches $S_1$ to $S_3$ are all operated in unison during the splice sequence. In actual practice, they would be relay contacts.

The output of amplifier 144 is fed via a series-connected resister 152, diode 154 and potentiometer 156 to the input of an integrator 158. The signal from the integrator is coupled by a resister 162 to the input of the error signal amplifier 126 where it is summed with the signal from amplifier 122. Also a feedback path from the output of the integrator 158 to the input of amplifier 144 is provided by way of a resister 164. The amplifier 144 and integrator function together as a linear ramp generator.

The output of amplifier 138 is also coupled by way of a resister 166 to one input of a multiplier 168. The signal level to that multiplier input varies in accordance with line speed of the web. Typically, it has a value of ten volts for a maximum line speed of 760 feet per minute (FPM). The minimum value of that input, typically one volt, is set by a minimum value circuit shown generally at 172. Thus the signal applied to one input of multiplier 168 can vary between 1 volt and 10 volts. The other input to the multiplier comes from the junction of resister 152 and diode 154. That input is coupled via a diode 182 to multiplier 168 and also to ground by way of a resister 184. The output from multiplier 168 is proportional to the product of the two inputs and is applied via a potentiometer 186 to the input of the ramp generator 158.

Still referring to FIG. 2, the signal from tachometer 110 which reflects the speed of the web entering the festoon 42 (FIG. 1) is coupled by a resister 192 to the input of the error signal amplifier where it is summed with the signals from amplifier 122 and integrator 158.

Control section 114 also includes provision for performing certain control functions when the speed of the web entering the festoon bears a selected relationship to line speed. More particularly, the output of the tachometer 110 is applied to a speed match circuit 174 which also receives the output of amplifier 138 reflecting web line speed. When the circuit detects that the two speeds are equal, it energizes a relay coil 176 to condition the system for a new splice sequence by resetting various relays which are of no importance for purposes of this description. By the same token, if there is no speed match, indicating that the apparatus is still in its splicing mode, i.e. web is decelerating, is at a standstill or is accelerating, circuit 174 de-energizes the relay coil 176 which opens a relay contact that prevents switches $S_1$ to $S_3$ from actuating.

The two tachometer outputs are also applied to an adjustable speed comparing circuit 185 whose output energizes a second relay coil 187. Circuit 185 is adjusted so that it produces an output when the speed of the web entering the festoon falls below a selected value relative to line speed. This permits relay coil 187 to initiate the closing of the splicing pads 84 and 86 (FIG. 1) in anticipation of the web being brought to a stop to minimize the time required to effect the splice.

During normal operation of the system, the voltage at the output of amplifier 138 varies in accordance with web line speed. Typically for a maximum line speed of 760 FPM, the voltage is on the order of 10 volts. For lower line speeds, the voltage is proportionately less. This voltage is applied by way of switch $S_2$, which is closed at this time, to the input of amplifier 144. This produces a 10 volt output from integrator 158 that is proportional to web line speed. Also, due to feedback of the integrator output via resister 164, the voltage at the junction of diodes 154 and 182 is held at 0 volts or a small negative level. Consequently no voltage is applied via diode 182 to multiplier 168.

The output of integrator 158 is summed with the 10 volt output from tachometer 110 and the signal from the dancer position amplifier 122 at the input of error signal amplifier 126. Resultantly, the output from amplifier 126 is a command signal for motor 108 that includes a web velocity trim signal that compensates for tension upsets as detected by excursions of the dancer 48 (FIG. 1) from its reference position P. Thus control section 114 which varies the voltage applied to the drive motor 108 assures that web is fed into the festoon to maintain the dancer roll within its control range and to maintain a set tension in the web throughout the builddown of the expiring web roll. Since the present system controllably feeds web into the festoon using DC motor driven fixed diameter nip rollers rather than by braking web at the roll stand, there is no need to change the gain of the system to compensate for the changing size of the expiring roll. By the same token the present splicing apparatus is relatively insensitive to changing characteristics of the roll stand brakes due to wear, bearing condition and the like.

In certain applications, it may be desirable to use the roll stand brakes 22 to provide additional tension should especially high web tensions be required for short time durations. This feature is incorporated conveniently into the present system to automatically apply the requisite pressure to brakes 22. More particularly, the armature current in motor 108 is directly proportional to the required braking force. This current can be sensed at the junction of resisters 134 and 136, as shown in dotted lines in FIG. 2, and applied to an amplifier 180 having a variable gain control. The output of the amplifier can then be used to control the roll stand brakes 22. Thus, for example, if the dancer is preloaded to provide a web tension of 100 lbs., the current in the motor 108 can be set for a hold back force of 50 lbs. and the roll stand brake set to provide the remaining 50 lbs. hold back force.

Assume now that the roll of running web W is about to expire and it is desired to splice the running web to the leading edge of the ready web W′ which has already been prepared on web positioning bar 78 and placed in splicing section 72 as shown in FIG. 1. At this point, there is a speed match between the web entering the festoon and the web leaving the festoon so that the speed match circuit 174 has conditioned the system for a splice sequence by permitting actuation of the switches $S_1$ to $S_3$. The operator can actuate switches $S_1$ to $S_3$ manually. Alternatively, that can be done automatically when the expiring roll reaches a predetermined minimum size as detected by a standard follower arm or automatic splicing system of the type described in U.S. Pat. No. 3,990,647.

The FIG. 1 apparatus includes means for automatically initiating the splice sequence when the trailing end of the running web leaves the core. More particularly, a light source 184 is mounted at the lower end of a standard 36. The light source is directed toward a detector 186 mounted on the base of roll stand 10. As long as the web is attached to the core of the expiring roll, light from source 184 cannot reach the detector. However, as soon as the trailing end of the running web W leaves the roll core, the light impinging on detector 186 initiates the splice sequence by actuating switches $S_1$ to $S_3$. A similar light source-detector arrangement is provided for the roll stand 12 carrying the ready web.

The actuation of the switches opens switch $S_1$ thereby cutting off the velocity trim signal from amplifier 122 to the amplifier 126. Also switch $S_2$ is open cutting off the line speed signal, while switch $S_3$ is closed thereby essentially grounding the input to amplifier 144. This causes the output of integrator 158 to ramp up to 0 volts at a rate dependent upon the time constant provided by potentiometer 156 and capacitor 158*a*. Also the feedback via resister 164 causes the voltage at the junction of diodes 154 and 182 to ramp from −10 to 0 volts. When the output of integrator 158 reaches 0 volts, the integration stops. Thus the command signal applied to the drive motor 108 causes the motor to brake to a stop at a controlled rate, e.g. from 0.5 to 1.8 seconds, so that the web entering the festoon is controllably decelerated to minimize tension upsets.

When the speed of the web entering the festoon reaches a selected point on the deceleration ramp as set by the speed comparing circuit 140, circuit 185 energizes the relay coil 187. That, in turn, initiates the closing of the splicing pads 84 and 86 (FIG. 1). Since the slope of the deceleration ramp is fixed, and since the time that it takes for the splicing pads to close is known, the speed comparing circuit is set so that the motor 108 is fully stopped by the time the splicing pads actually press the webs W and W′ together between positioning bars 78 and 82. The closing of the splicing pads, in turn, initiates actuation of the knife 92 that will sever the running web. Again, to minimize the duration of the splice sequence and thus minimize the required amount of web storage in festoon 42, the knives are actuated in anticipation of the pressure pads fully closing.

When the web is stopped, it is desirable to apply a small forward torque to the nip rollers to maintain some tension in the web between the rollers and the positioning bars 78 and 82. This assures that there will be no web slack ahead of roller 96 that could cause a web break when the web is accelerated up to line speed. FIG. 2 illustrates in dotted lines a convenient way to do this. A normally closed switch $S_4$ is included at the output of amplifier 126. A second normally open switch $S_5$ connected between the junction of switch $S_4$ and resister 128 and a constant current source 190. The closing of pressure pads 84 and 86 (FIG. 1) energizes a relay coil 191 which actuates the switches $S_4$ and $S_5$. Thus at zero speed of the web, a small command signal from source 190 controls motor 108 so that it exerts a small forward torque on the nip rollers.

Finally, the bottoming of the knife is sensed by any convenient means to initiate retraction of the pressure pads and to initiate the acceleration segment of the splice sequence by returning switches $S_1$ to $S_3$ (and switches $S_4$ and $S_5$) to their original positions. Now the velocity trim signal from amplifier 122 is again applied to amplifier 126 and the 10 volt voltage that is proportional to web line speed is applied to the input of amplifier 144. This is immediately applied to the junction of diodes 154 and 182. Diode 154 is cut off and the voltage is coupled via diode 182 to multiplier 168 which also receives the line speed voltage directly from amplifier 138 via resister 166. If the line speed is high, then the voltage from multiplier 168 is relatively high causing the integrator to ramp down at a relatively high rate so that the output of the integrator reaches the −10 volt voltage proportional to line speed within the alotted time. On the other hand, if web line speed is relatively slow, a lesser voltage is applied to multiplier 168 so that a smaller voltage is coupled to integrator 158 causing it to generate an accelerating ramp of smaller absolute slope.

Thus the present system provides a controlled acceleration to the web during the acceleration phase of the splice sequence to limit the tension imparted to the web to a preset maximum. In other words, the tension applied to the web may be expressed as follows:

$$\text{force} = \frac{\text{roll weight times acceleration}}{2g}$$

Therefore it can be seen that halving the weight of the web roll halves the amount of tension required to accelerate that roll up to line speed in a given amount of time. Furthermore, since $$\text{acceleration} = \frac{\text{web velocity}^2}{\text{2 times required web length}}$$

it is seen that the present system can provide variable acceleration rates to automatically apply the least necessary tension for new roll acceleration consistent with a given splicing speed.

When the system has accelerated the ready web W′ up to line speed, the speed matching circuit 174 detects this and conditions the system for a new splice sequence.

Figure 3:
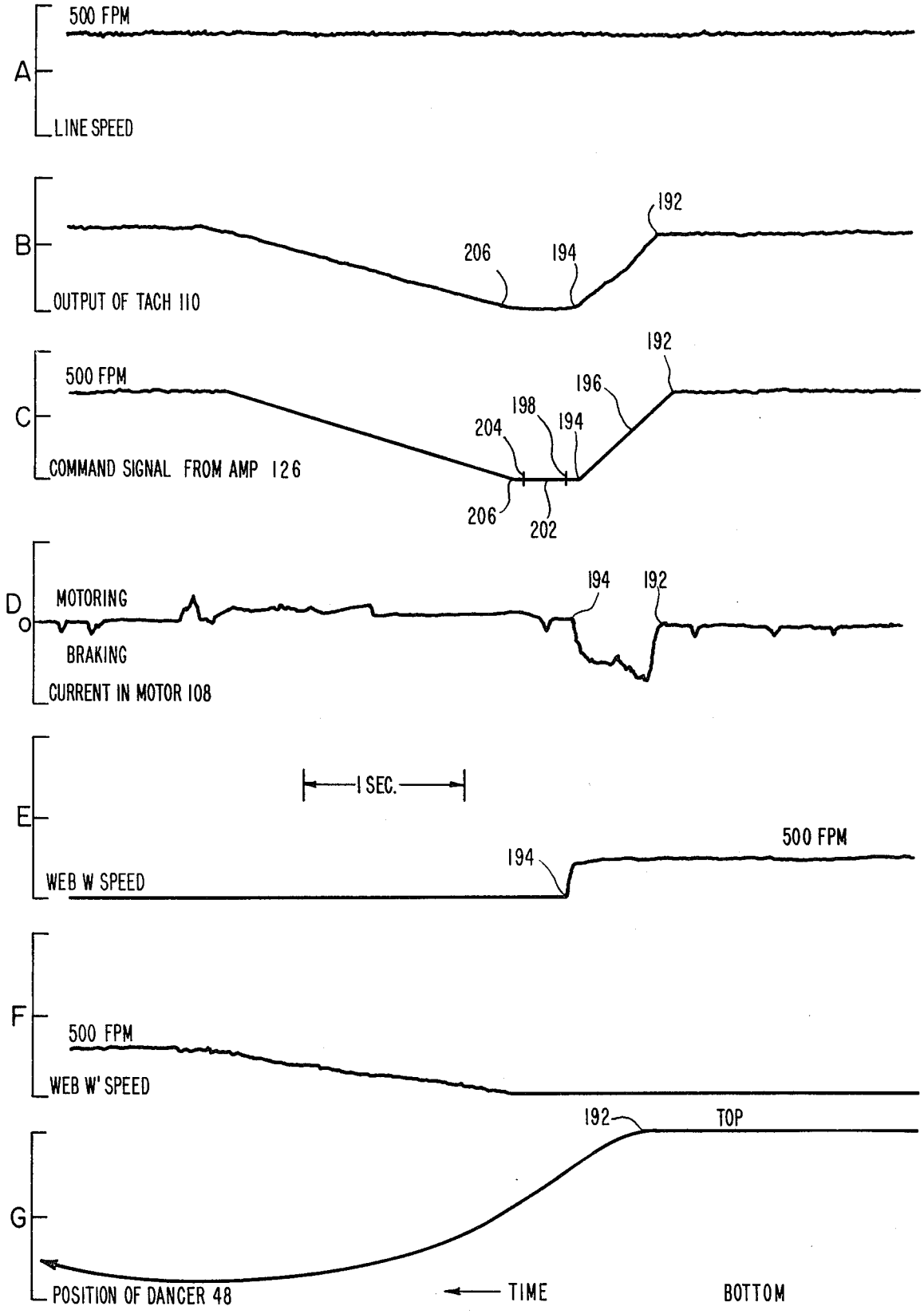
FIG. 3 is a series of graphs further illustrating the operation of the FIG. 1 apparatus.

FIG. 3 illustrates the operation of the various elements of the present apparatus. The curve in FIG. 3A represents a web line speed of 500 fpm as measured by the tachometer 112 versus time. The time basis is from right to left. The curve in FIG. 3C is the command signal from error signal amplifier 126 and the FIG. 3B curve is the signal from tachometer 110. As can be seen from those curves, the splice sequence is commenced at point 192. A decelerating ramp (FIG. 3C) is applied to motor 108 causing it to come to a stop at point 194 (FIGS. 3B and 3E). Approximately half way along that downward ramp, at point 196, the pressure pads 84 and 86 are actuated. These pads actually close fully at point 198 after the web has been stopped. The closure of the pressure pads (or their substantial closure) fires the knife 92 at point 202. The knife actually closes or bottoms at point 204. This trips a switch that retracts the pressure pads 84 and 86 and initiates the acceleration phase of the splice sequence at point 206 by accelerating the ready web W′ up to line speed as shown by the curve in FIG. 3F. During the splice sequence, web is drawn from the festoon 42 by the downstream machine beginning at point 192 at the beginning of the decleration ramp (see FIG. 3G). It continues to be drawn from the festoon through the acceleration phase. Eventually motor 108 accelerates the web entering the festoon until it reaches line speed and in fact a little beyond that point in order to fill up the festoon and return the dancer 48 to its reference position P. The velocity trim signal from the dancer position amplifier 122 accomplishes this.

The curve in FIG. 3D represents the armature current in motor 108. When the current is below the 0 level, the motor is in its braking mode and functioning as a generator which returns power to the utility lines so that it actually contributes to the efficient operation of the present apparatus. This is in sharp contrast to the roll stand brakes normally used to control web tension which waste energy as heat. As can be seen from that curve, during the acceleration phase of the splice sequence, the motor 108 is operating as a motor until the ready web reaches line speed and the festoon is refilled, whereupon it returns to its generating mode of operation.

It will thus be seen that the objects set forth above among those made apparent from the preceding description are efficiently attained, and since certain changes may be made in the above construction without departing from the scope of the invention, it is intended that all matter contained in the above description or shown in the accompanying drawings be interpreted as illustrative and not limiting in sense.

It is also to be understood that the following claims are intended to cover all of the generic and specific features of the invention herein described.

We claim:

1. A splicer of the type including a roll stand, a splicing station and a festoon including adjacent fixed rollers, a dancer and a track permitting the dancer to be movable toward and away from the fixed rollers, said festoon being downstream from the splicing station, the improvement comprising A. a pair of nip rolls between the splicing station and the festoon, B. a motor connected to drive the nip rolls to feed the web from the roll stand into the festoon, C. means for monitoring web speed into the festoon to produce a first signal, D. means for monitoring web speed out of the festoon to produce a line speed signal, E. means for monitoring excursions of the festoon dancer from a selected reference position to produce a web velocity trim signal, F. means for processing said signals to develop a command signal for said motor that causes said motor to controlledly vary the torque applied to the nip rolls so as to maintain substantially constant tension in the web downstream from the rolls, and G. means for biasing the dancer away from the fixed rollers including i. a controllable variable slip clutch having an input shaft and an output shaft, ii. a motor connected to the clutch input shaft, and iii. means coupled between the clutch output shaft and the dancer for urging the dancer away from the fixed rollers with a force dependent upon the amount of slippage in the clutch.

2. The splicer defined in claim 1 wherein the clutch is a fluid controlled clutch.

3. The splicer defined in claim 1 and further including

A. fixed diameter rollers rotatively mounted upstream and downstream relative to the festoon, and B. wherein the web speed in and web speed out monitoring means comprise tachometers driven by the upstream and downstream rollers respectively.

4. A splicer of the type including a roll stand, a splicing station and a festoon including adjacent fixed rollers, a dancer and a track permitting the dancer to be movable toward and away from the fixed rollers, said festoon being downstream from the splicing station, the improvement comprising A. a pair of nip rolls between the splicing station and the festoon, B. a motor connected to drive the nip rolls to feed the web from the roll stand into the festoon, C. means for monitoring web speed into the festoon to produce a first signal, D. means for monitoring web speed out of the festoon to produce a line speed signal, E. means for monitoring excursions of the festoon dancer from a selected reference position to produce a web velocity trim signal, F. means for combining the first, line speed and trim signals to produce a command signal, G. means responsive to the command signal for controlling the armature voltage to said motor, H. a ramp voltage generator, and I. means for applying the output of the ramp voltage generator to the combining means in lieu of the line speed and trim signals so that the command signal is a voltage ramp that brakes the motor to a stop within a selected fixed time interval.

5. The splicer defined in claim 4 and further including

A. a constant current source, and

B. means for applying the current from said source to said control means in lieu of the command signal from said combining means when the motor is stopped so that the motor exerts a small forward torque on the nip rolls to maintain the web between the nip rolls and the splicing station under tension.

6. The splicer defined in claim 4 and further including

A. means for comparing said first and line speed signals to develop a control signal when the first signal bears a selected relationship to the line speed signal indicating that the speed of the web entering the festoon has reaches a selected value relative to the speed of the web out of the festoon, and B. means for applying the control signal to control the operation of said splicing station in anticipation of the slowing to a selected speed or stopping of the web entering the festoon.

7. The splicer defined in claim 4 and further including means for controlling the ramp voltage generator after the web entering the festoon is stopped so that said generator delivers a ramp voltage to the combining means whose slope produces a command signal from the combining means that causes said motor to accelerate the nip rolls feeding web into the festoon up to line speed within a selected time interval.

8. The splicer defined in claim 7 and further including means for controlling the ramp voltage generator in accordance with line speed when the nip rolls are accelerated so that the absolute slope of the voltage ramp from the ramp voltage generator varies directly with line speed.

9. Web splicing apparatus as defined in claim 4 wherein

A. said motor is a DC motor, and

B. said combining means comprises a closed servoloop including said motor that regulates the voltage applied to said motor.

10. Web splicing apparatus as defined in claim 4 and further including

A. means for detecting the absence of web from the web source to produce a no-web signal, and B. means for applying the no-web signal to control the operation of the slicing station.

11. A web splicing apparatus comprising

A. a roll stand,

B. a splicing station,

C. means for moving web from the roll stand through the splicing station,

D. a festoon positioned to receive web leaving the splicing station, said festoon comprising (1) fixed adjacent rollers, (2) a dancer, (3) means defining a track for the dancer so that the dancer is movable toward and away from the fixed rollers, and (4) means for biasing the dancer toward one end of the track away from the fixed rollers, said biasing means including (a) a controllable variable slip clutch having an input shaft and an output shaft, (b) a motor connected to the clutch input shaft, and (c) means coupled between the clutch output shaft and the dancer for urging the dancer toward said one end of the track with a force dependent upon the amount of slippage in the clutch, E. means for monitoring the web speed into the festoon to produce a first signal, F. means for monitoring web speed out of the festoon to produce a line speed signal, G. means for monitoring excursions of the dancer from a selected reference position to produce a web velocity trim signal, and H. means for processing said signals so as to control the torque applied to the nip rolls to maintain substantially constant tension in the web downstream from the nip rolls.

12. The web splicing apparatus defined in claim 11 wherein the clutch is a fluid controlled clutch.

13. Web splicing apparatus as defined in claim 11

A. wherein the moving means comprise (1) a pair of nip rolls positioned between the splicing station and the festoon, and (2) a motor connected to drive at least one of the nip rolls to feed the web from the roll stand into the festoon, and B. wherein the processing means monitors said first signal along with said line speed and trim signals in a closed servo loop including said motor so as to regulate the voltage to the motor to maintain substantially constant web tension.

14. A splicer of the type including a roll stand, a splicing station and a festoon including adjacent fixed rollers, a dancer and a track permitting the dancer to be movable toward and away from the fixed rollers, said festoon being downstream from the splicing station, the improvement comprising A. means for controlledly advancing web from the splicing station into the festoon, and B. means for biasing the dancer away from the fixed rollers including (1) a controllable variable slip clutch having an input shaft and an output shaft, (2) a motor connected to the clutch input shaft, and (3) means coupled between the clutch output shaft and the dancer for urging the dancer away from the fixed rollers with a force dependent upon the amount of slippage in the clutch.

* * * * *